United States Patent [19]

Shenoha

[11] 4,073,117

[45] Feb. 14, 1978

[54] PACKAGING MACHINE WITH INFLATED BAG PRINTER AND METHOD

[75] Inventor: James L. Shenoha, Lockport, Ill.

[73] Assignee: Norwood Marking and Equipment Co., Inc., Downers Grove, Ill.

[21] Appl. No.: 719,823

[22] Filed: Sept. 2, 1976

[51] Int. Cl.[2] ..... B65B 61/02

[52] U.S. Cl. ..... 53/14; 53/131; 53/189; 101/44

[58] Field of Search ..... 53/14, 131, 385, 189; 101/43, 44

[56] References Cited

U.S. PATENT DOCUMENTS

| | | | |
|---|---|---|---|
| 2,071,247 | 2/1937 | Benoit et al. | 53/131 X |
| 2,293,498 | 8/1942 | First et al. | 53/131 X |
| 2,567,232 | 9/1951 | Nordquist et al. | 101/44 |
| 3,358,414 | 12/1967 | Hersh et al. | 53/131 X |
| 3,508,379 | 4/1970 | Noyes et al. | 53/385 X |
| 3,540,182 | 11/1970 | Price | 53/3 |
| 3,881,410 | 5/1975 | Shenoha | 53/131 X |
| 3,994,217 | 11/1976 | Archila | 101/43 |

*Primary Examiner*—Othell M. Simpson
*Assistant Examiner*—John Sipos
*Attorney, Agent, or Firm*—Hill, Gross, Simpson, Van Santen, Steadman, Chiara & Simpson

[57] ABSTRACT

A method and device for imprinting indicia on a product bag in cooperation with a product bagging machine in which the imprinting operation does not hinder or interfere with an accelerated packaging operation, including the steps of first continuously moving products to be bagged along a conveying surface in a spaced and generally aligned end-to-end relationship, second inflating a product bag by an air jet in order to receive the product, third prior to filling the inflated bag shifting it laterally into contact with a printer head of an imprinter device which is disposed off to the side of the moving stream of aligned and spaced products, and fourth imprinting the inflated bag during the interval of time that the space between adjacent moving products is adjoining the imprinter device. The apparatus provides means for moving aligned and spaced products along a conveying surface past a laterally disposed imprinter device and utilizing an air jet to inflate a product bag to raise an imprint surface thereon into proximity of the imprinter device, thereafter using a shifting means to laterally move the bag imprint surface into contact with a printer head of the imprinter device and providing a timing means to accommodate imprinting the inflated bag immediately prior to filling the bag with the product.

14 Claims, 9 Drawing Figures

Fig. 5
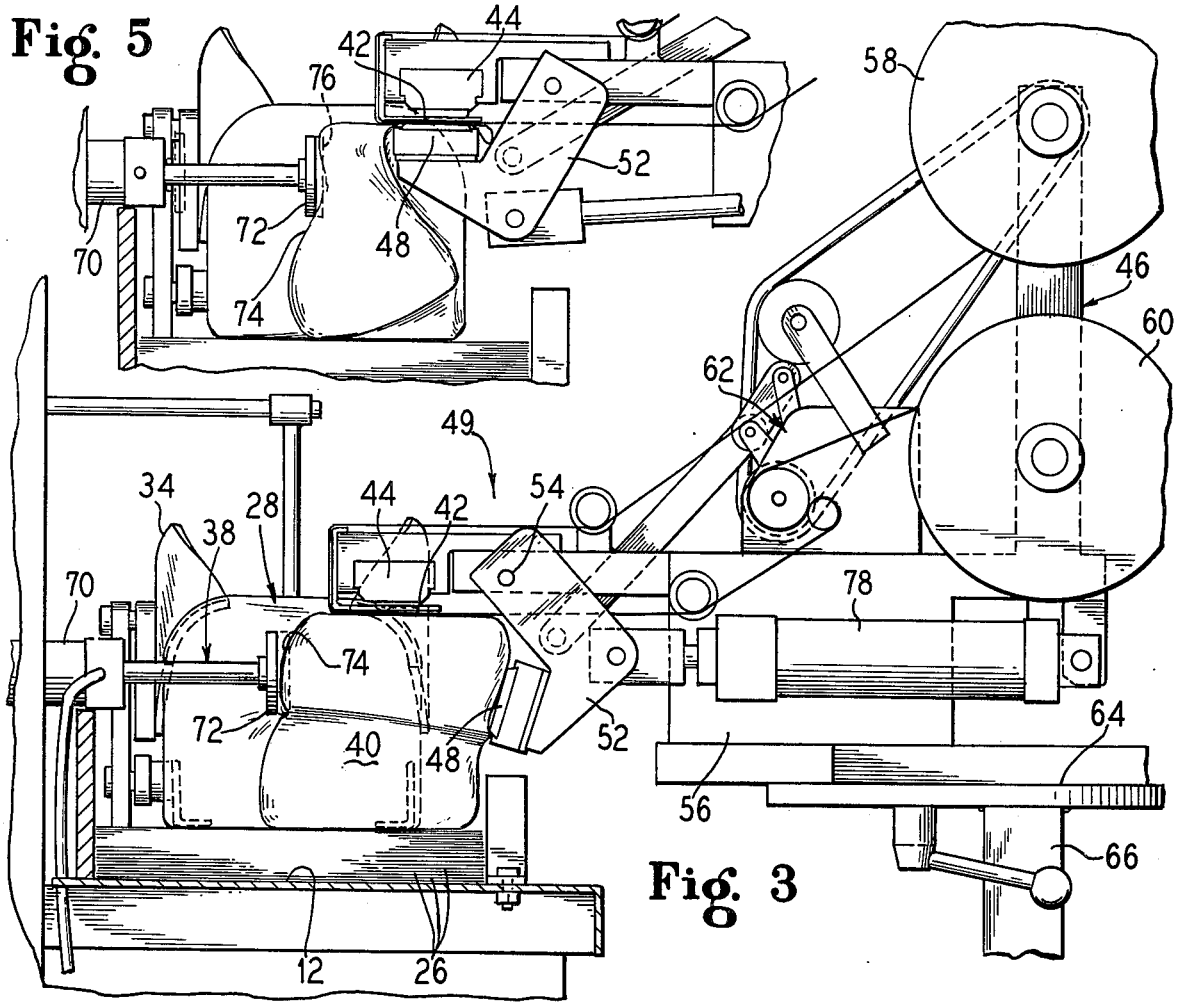
Fig. 3
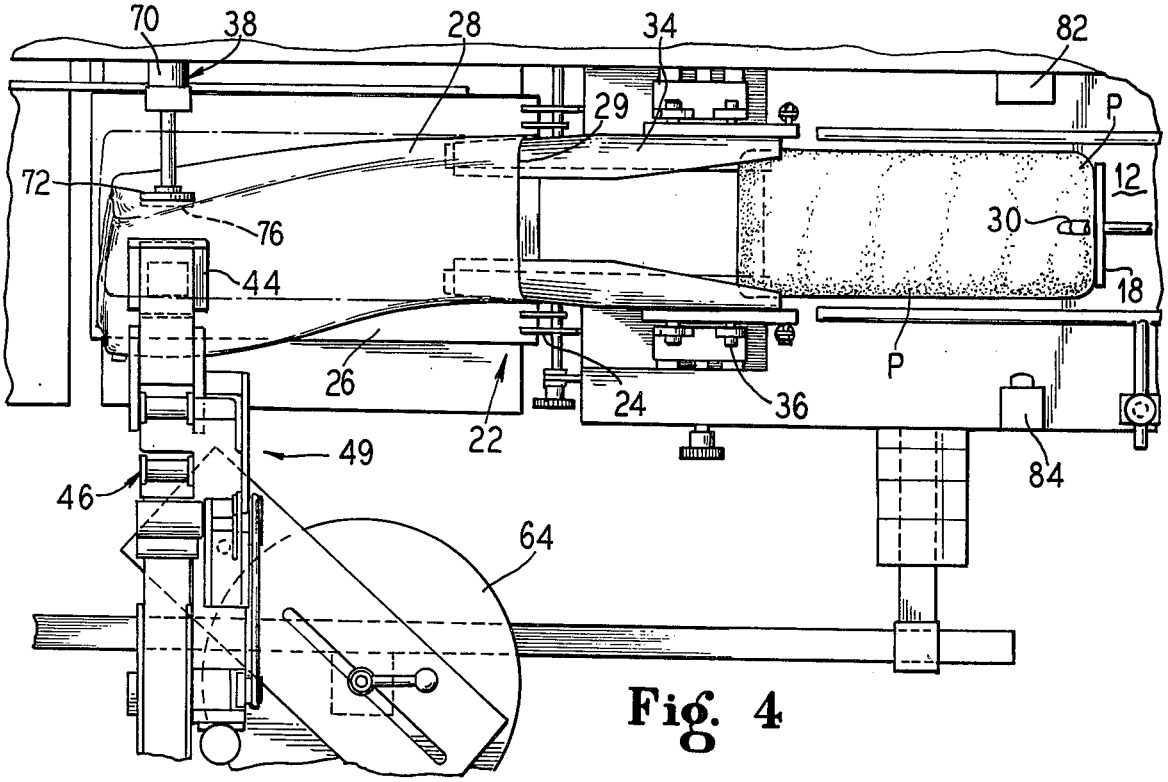
Fig. 4

PACKAGING MACHINE WITH INFLATED BAG PRINTER AND METHOD

BACKGROUND OF THE INVENTION

1. Field of the Invention

This invention relates to marking devices adapted for use with product packaging machines and more particularly to a method and device of applying indicia to product bags which does not hinder or interfere with a product packaging operation.

2. Prior Art

Imprinting devices are in general current use to apply last-minute indicia to pre-printed wrappers or bags, immediately prior to filling the bags with a product, especially perishable food products such as bread or the like. Such last-minute indicia may include dating, pricing or other coded information which cannot be printed at the time the bags are manufactured. Because of the difficulty of applying printing to a stack of bags or after the bags are filled with a fragile product, inflated bag printing devices have been generally utilized to apply last-minute indicia in current packaging operations. Such an inflated bag printing device is described and shown in my U.S. Pat. No. 3,823,664, issued July 16, 1974, entitled "Inflated Bag Printer and Method". Therein, the impriting device is generally utilized adjacent to a bag inflating station where a stack of deflated bags are positioned prior to filling with a product. Each bag, in turn, is inflated by a jet of air directed at an open end of the bag at the top of the stack with the open end maintained in an expanded condition by a mechanical gripping mechanism which also releases the bag from the inflating position and moves it to a bag filling station where an awaiting product is to be packaged. However, prior to moving the bag to the filling station the imprinting device is activated to apply indicia to the inflated bag by taking advantage of the bags' inflating operation which is arranged to move a surface of the bag into contact with a marking face of the imprinter. The marking face is positioned directly above the inflated bag adjacent its closed end whereby activation of an anvil or striker of the imprinter at the closed end of the bag deflates and collapses a portion of the bag to thrust an imprint surface of the bag against the marking face. The anvil is then removed from contact with the bag whereupon the imprinted bag is moved to the filling station by the mechanical gripping mechanism.

While this mode of bag imprinting has been extremely successful in the past, newly developed, high production product packing machines preclude the use of past imprinting arrangements. Herein, a rapid continuous flow of products move along a conveying surface in aligned and spaced relationship to one another, from a receiving station to a discharge station. Intermediate the receiving station and the discharge station inflated bags are placed in the path of the product flow to individually intercept each of the products. Herein, the flow of products along the conveying surface is effective to fill the bags and transport the product filled bag to the discharge station at a relatively high continuous rate. Thus, it will be seen that past imprinting devices which are positioned directly above and behind the inflated bags would interfere with the continuous straight through flow of these highly productive packaging machines.

SUMMARY OF THE INVENTION

My invention provides a device and a method for use with continuous product flow types of packaging machines for applying printed indicia to product wrappers or bags which is compatible with these highly productive packaging machines and which does not interfere or hinder the product packaging operation. Typically, these most efficient machines which are now commonly used for wrapping bread or buns and the like, provide a conveying surface extending between a product receiving station and a product discharge station and having a bag inflating station intermediate the receiving and discharge stations. A stacked supply of flattened bags, having one end thereof sealed, are held in position adjacent the inflating station by a gripping means. An air jet directed at an open unsealed end of the topmost bag will inflate it to accommodate filling with product. The conveying surface being equipped with suitable guides, provides for the aligned and spaced transport of packageable products therealong by spaced product filling pusher members, which are continuously driven by an appropriate drive means. Thus, while continuously advancing the products along the conveying surface, the filling members individually load the products into an inflated bag which is interposed in the product flow path to intercept an approaching product. After abutting the sealed end of the bag the continued product advance frees the bag from the gripping means and the product filled bag is conveyed along to the discharge station. However, prior to filling the inflated bags with the product they are imprinted with required indicia. When the filled bag clears the inflating station and before the following product arrives, the next bag at the top of the stack is inflated by the air jet. An inflated bag imprinter device is adjustably positioned at an imprinting station which is adjacent the inflating station and disposed laterally of the conveying surface to be clear of the product flow to allow unobstructed movement of the product and product pusher members past the imprinter device. Immediately after the top bag is inflated, a portion of the bag having a desirable imprinting surface area is shifted laterally by a shifting means, against a marking face carried by the imprinter device and the imprint is then applied by the action of an anvil or striker arm. The striker arm and the shifting means are quickly deactivated whereupon the pusher member fills the inflated bag with the following product. A timing means is provided to sequentially control the various operations in timed relationship with the conveying movements of the spaced products along the conveying surface.

It is, therefore, an object of this invention to provide an imprinting device for applying printed indicia to product bags which is compatible with an "in-line, continuous bagger" packaging machine.

It is another more specific object to provide an imprinting device, which is positioned laterally to clear continuously moving spaced products through a packaging machine, for imprinting an inflated bag which includes a lateral shifting means to deflect an imprint surface of the bag against an imprint marker of the imprinting device.

It is still another object of this invention to provide a method and apparatus for imprinting product bags which includes means to inflate the bag to elevate an imprint surface of the bag into proximity of an imprint marker positioned laterally of the product bag imprint surface and means to shift the bag laterally to bring the imprint surface against the imprint marker.

Other objects, features and advantages of the present invention will be readily apparent from the following description of the preferred embodiments thereof taken in conjunction with the accompanying drawings although variations and modifications may be effected without departing from the spirit and scope of the novel concepts of the disclosure.

BRIEF DESCRIPTION OF THE DRAWINGS

FIG. 3 is a sectional view taken along the line III—III of FIG. 2 showing the inflated bag shifted to the side immediately prior to the print cycle;

FIG. 4 is a plan view of the imprint and inflation stations;

FIG. 5 is a fragmentary view similar to FIG. 3 but showing the imprinting device in its activated position when applying the indicia to the inflated and side shifted bag.

DESCRIPTION OF THE PREFERRED EMBODIMENTS

Figure 1:
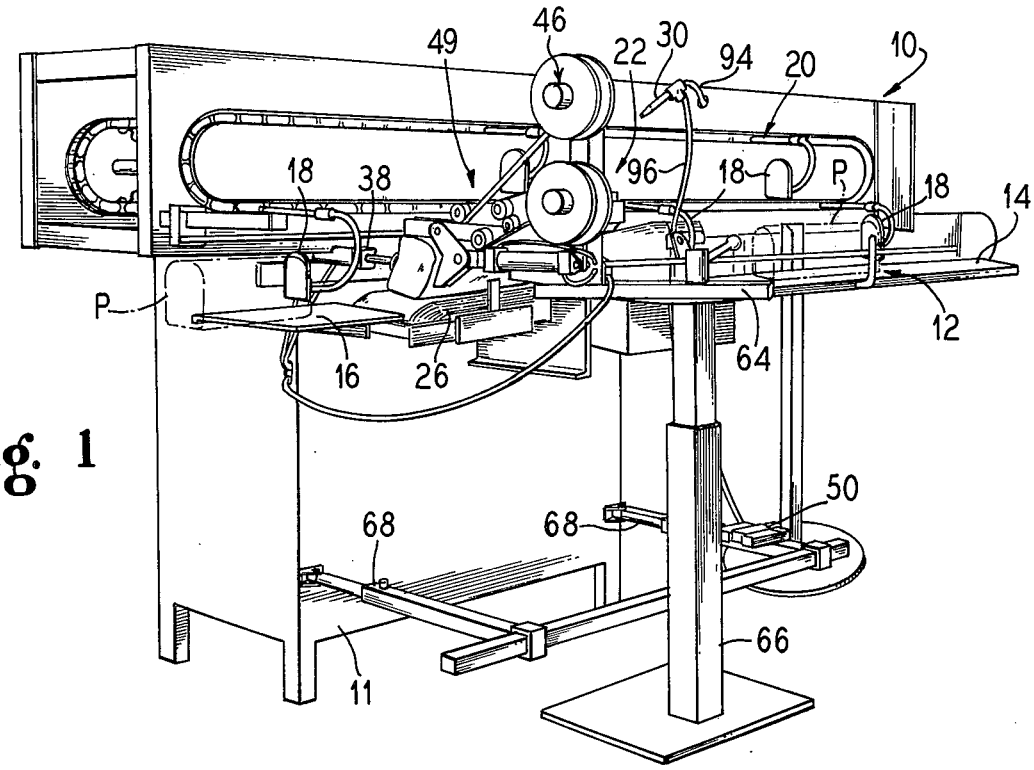
FIG. 1 is a perspective view of a product packaging machine embodying features of the invention.
Figure 2:
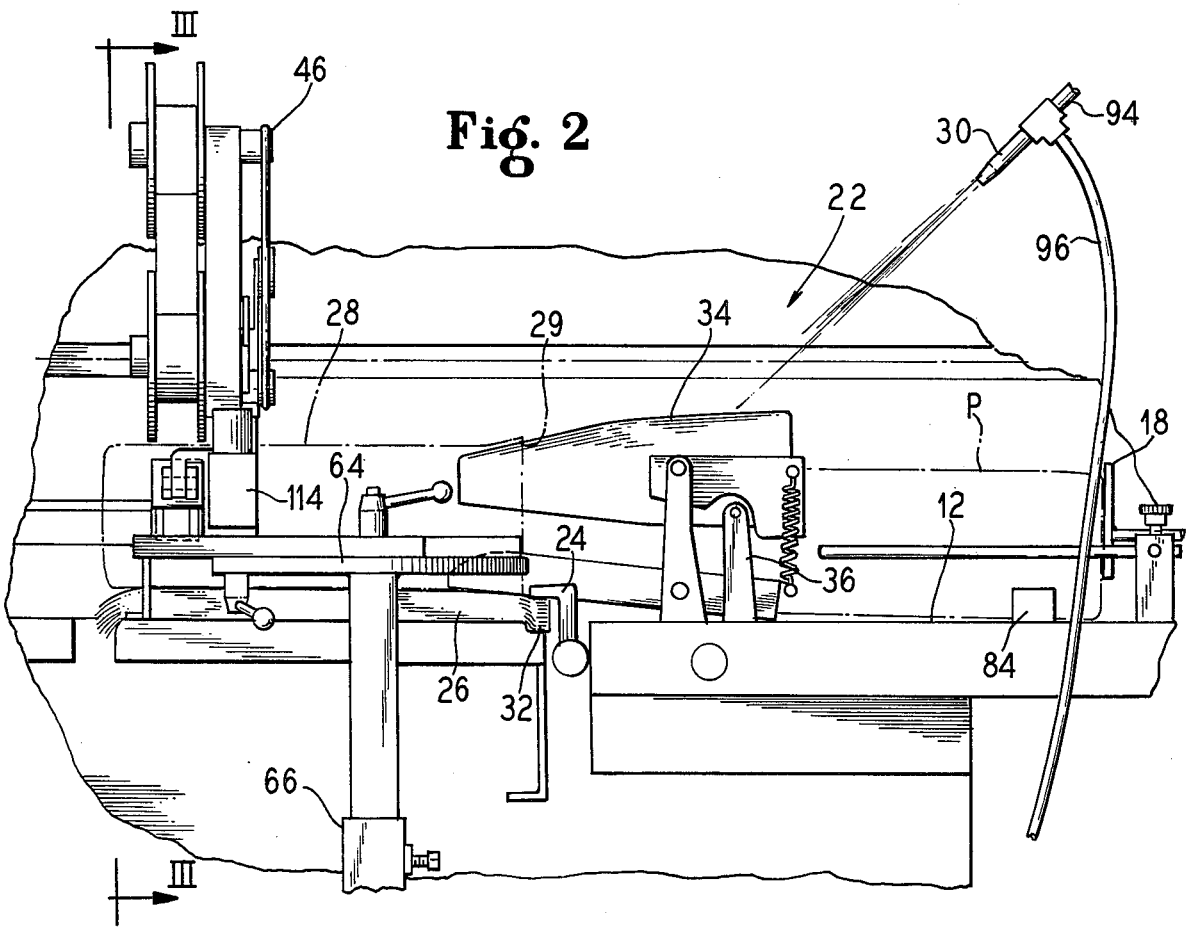
FIG. 2 is an enlarged fragmentary elevational view of the imprint and inflation stations of the packaging machine of FIG. 1.

FIG. 1 illustrates an in-line, continuous product flow bagging or packaging machine 10 having a frame 11 with a conveying surface 12 thereon to support a moving stream of packageable products "P" from a receiving station 14 to a discharge station 16. Packageable products P such as bread or the like are delivered to the receiving station 14 by suitable means (not shown) and are individually moved along the conveying surface 12 toward the discharge station 16 in a spaced in-line relationship by continuously moving spaced pusher paddles 18 of a product filling means 20. An inflating station 22, located intermediate the receiving and discharge stations of the conveying surface 12, is provided with a gripping means 24 to retain a plurality of flattened flexible product bags 26 in a suitable position whereby the top bag 28 may be inflated by a jet of air directed toward an open mouth 29 of the bag 28 by a nozzle 30. Each bag 26 is provided with a bottom flap 32 by which the gripping means 24 retains the bags 26 in the inflating station while allowing bag mouth 29 to fully open and accept the insertion of a loading guide 34 by a suitable sequenced drive means 36. The loading guide 34 expands the bag mouth 29 and facilitates loading the product into the inflated bag 28. However, prior to filling the bag, a bag shifting means 38 is activated to force the closed end 40 of the bag 28 laterally on the conveying surface 12 to place an imprint surface 42 of the bag 28 snugly against an imprint marker 44 of an inflated bag marking device 46. An anvil or striker 48 is then activated automatically by a sequential timing means 50, to apply printed indicia to the imprint surface 42.

It may be seen in FIG. 3 that the inflated bag marking or imprinting device 46, which is of a type similar to the inflated bag printer described in my U.S. Pat. No. 3,823,664, issued July 16, 1974, is positioned at an imprinting station 49, adjacent the inflating station, which is sufficiently to the side and above the conveying surface 12 to provide ample clearance for unobstructed flow of the aligned and spaced products P along the conveying surface. The inflated bag marking device 46 provides a movable striker arm 52 for supporting the anvil means 48 for pivotal movement about a pivot pin 54 carried in a base member 56. The base member 56 further supports the imprint marker and the usual tape supply and take-up reels 58 and 60, respectively, and the tape advancing means 62 and is adjustably positioned relative to the conveying surface 12 on a table 64 and by a vertically telescopic leg 66 and a pair of horizontal telescopic legs 68, 68 to accurately locate the marking device 46 in the imprinting station 49.

As shown in FIGS. 1 to 4, the bag shifting means 38 comprises a fluid cylinder 70 having a pusher member 72 extensibly activated to abut a side wall 74 of the bag 28, adjacent the closed end 40. As best seen in FIG. 4 the inflated bag, closed end 40 is sufficiently rigid to permit the pusher member 72 to shift the formed bag laterally into the imprinting station 49 and against the anvil means 48 whereby the imprint surface 42 of the bag is brought into contact with the imprint marker 44. Immediately thereafter indicia is applied to the imprint surface 42 by the action of a cylinder 78. The cylinder is connected to the striker arm 52, to drive the anvil means 48 toward the imprint marker 44, thereby collapsing a portion of the bag (as seen in FIG. 5) to thrust the imprint surface 42 of the bag 28 firmly against the imprint marker 44. The imprinting operation is more fully described in the aforementioned U.S. Pat. No. 3,823,664, the teachings of which are herein incorporated by reference. The pusher member 72 may be cushioned with a soft yieldable abutment face 76 to minimize any damage to fragile bags.

After the bag 28 has been imprinted, the anvil means 48 is quickly withdrawn from contact with the bag by the cylinder 78 and the pusher member 72 is retracted from the sidewall 74 to allow the bag 28 to shift back to its normal straight configuration produced by the initial inflating process, shown in broken lines in FIG. 4, to accommodate loading the bag with the oncoming product. As the product "bottoms" in the bag's closed end 40 the continuing advancing pusher paddle 18 frees the bag from the gripping means 24 and the loading guide 34 to move the imprinted and product filled bag downstream to the discharge station 16.

Thus, it will be appreciated that the bag imprinting operation must take place during the interval of time a space between adjacent moving products is adjoining the inflated bag marking device 46, that is immediately prior to filling the bag with a product and following the removal of a previously filled product bag from the imprinting station 49.

For this purpose the timing means 50 is provided to sequentially preform the various required operations in timed relationship with the conveying movements of the spaced products along the conveying surface.

Figure 9:
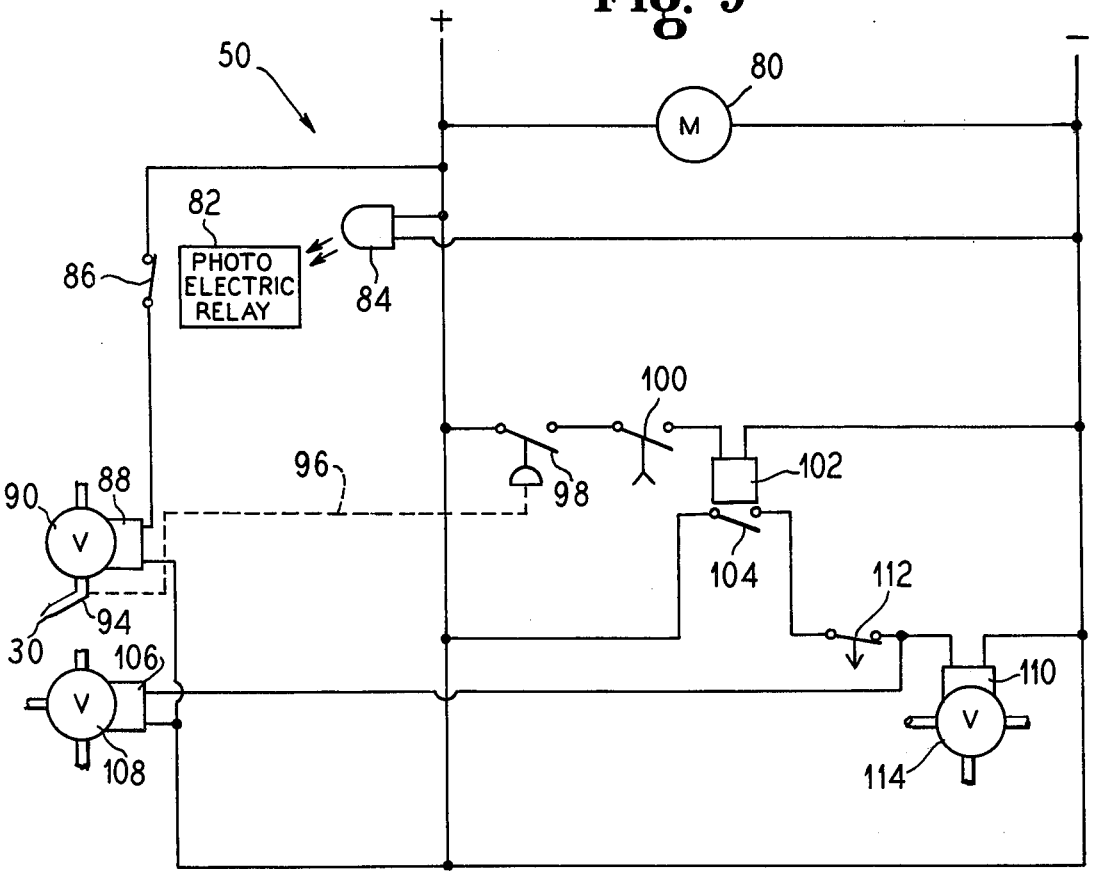
FIG. 9 is an electrical circuit diagram of the timing means for controlling the imprinting operation of the packaging machine.

Now with specific reference to FIG. 9 of the drawings, a conveyor motor 80 is provided to drive the product filling means 20 to advance the products along conveying surface 12 by the spaced pusher paddles 18.

A photoelectric relay 82 is energized by a sensor light source means 84 to hold open a normally closed relay contact 86. The sensor means 84 is positioned to beam a light across the conveyor surface 12 at said relay 82 whereby a product moving along the conveying surface will break the beam and de-energize the relay 82 and allowing the contact 86 to close. When the normally closed contact 86 is closed a circuit is completed to a solenoid 88 of an air valve 90. Energization of the solenoid 88 opens the valve 90 to supply pressure to the air line 94 and to the nozzle 30, providing the air jet to inflate the top bag 28 (see FIGS. 1 and 2). A branch air line 96 communicates with a pressure activated switch 98 which upon detecting pressure in the line closes the switch to complete a circuit to a time delay (closing) switch 100.

After a predetermined time delay, the time required to fully inflate the bag 28, switch 100 closes to energize relay 102 and close relay contact 104. When contact 104 closes solenoid 106 is energized to activate air valve 108, supplying pressure to the cylinder 70 to extend pusher member 72 and shift the bag closed end 40 into the imprinting position. Concurrently with energizing the solenoid 106 a solenoid 110 is also energized through a normally closed time delay switch 112. Energizing solenoid 110 actuates an air valve 114 to supply pressure to the cylinder 78 which thrusts the anvil means 48 toward the imprint marker 44 to imprint the bag.

After a predetermined time delay the normally closed time delay switch 112 opens, de-energizing solenoid 110 to reverse the valve's pressure connection to the cylinder 78 and retract anvil means 48. Solenoid 106 will also be de-energized to reverse pressure connections to cylinder 70 and thereby withdraw pusher member 72 from contact with the bag sidewall 74. Further, as the product moves past the sensor beam, upon approaching the inflated bag mouth 29, the photoelectric relay 82 is again energized causing the normally closed relay contacts 86 to open and de-energize solenoid 88. This causes the valve 90 to close and stop the air pressure flow from the nozzle 30. Thus, if a product is not picked up and moved along the conveying surface 12 by the pusher paddles 18 the light beam will not be broken and the imprinting sequence will not function, allowing the pusher paddle 18 to pass over the stack of flattened product bags 26.

Figure 6:
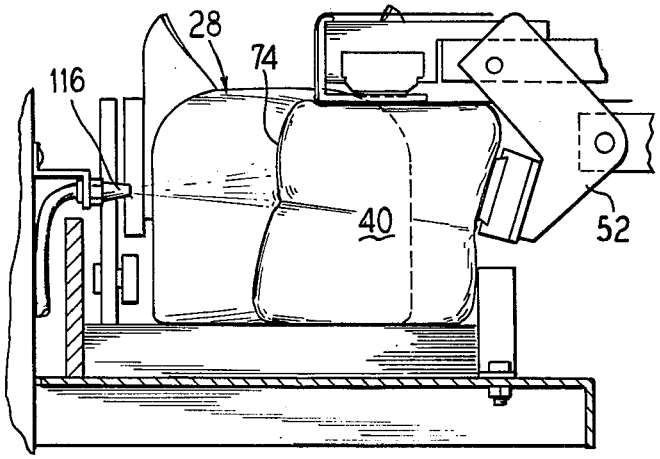
FIG. 6 is a fragmentary view similar to FIG. 3 but showing an alternate form of the means to laterally shift a portion of the inflated bag into an imprinting position.
Figure 7:
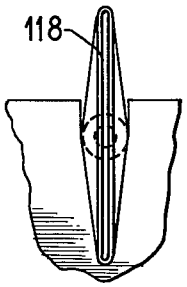
FIG. 7 is an enlarged fragmentary view showing a modified nozzle configuration of the lateral shifting device shown in FIG. 6.
Figure 8:
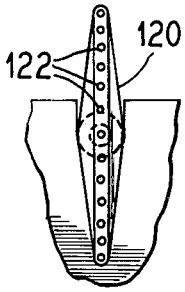
FIG. 8 is a view similar to FIG. 7 but showing yet another nozzle configuration of the lateral shifting device.

Alternate forms of bag shifting means are shown in FIGS. 6, 7 and 8 which may be effectively utilized with certain bag filling installations. In FIG. 6 a nozzle 116 is provided in place of the cylinder 70 and which directs a jet of air against a spot area of the bag sidewall 74 to achieve the lateral shifting of the product bag. FIG. 7 provides a vertically elongated nozzle 118 capable of directing a jet of air against substantially the full height of the bag sidewall 74 and the nozzle 120 of FIG. 8 provides a plurality of vertically extending nozzle orifices 122 to direct a plurality of air jets against the bag sidewall 74.

It can, therefore, be seen from the above that my invention provides a method and apparatus for imprinting indicia on a product bag which is compatible with continuous product flow bagging machines which does not interfere with the packaging operation.

Although the teachings of my invention have been disclosed with references to specific embodiments, it is to be understood that these are by way of illustration and that variations and modifications may be effected without departing from the spirit and scope of the novel concepts of my invention.

I claim as my invention:

1. A method of imprinting product bags by forcing an imprint surface thereof against a marking device which comprises the steps of positioning a stationary deflated flexible bag laterally of a marking device, inflating at least a portion of the flexible bag by means of an air jet, laterally shifting a portion of the inflated flexible bag into contact with the marking device, deflating a portion of the inflated portion of the bag while moving a surface of the bag adjacent the deflated portion against the marking device, marking the imprint surface by the device and withdrawing the surface from the marking device, and returning the portion of the flexible bag to the original non-laterally shifted position, out of contact with the marking device.

2. A method of imprinting product bags during an accelerated product bagging operation including the steps of continuously moving products along a conveying surface in spaced, aligned end-to-end relationship; positioning a deflated flexible bag in the path of the moving products adjacent the conveying surface; inflating the bag by means of an air jet; laterally shifting a portion of the inflated bag into contact with a marking device disposed off to the side of the moving products while maintaining a second portion of the flexible bag in a fixed position to intercept a moving product; and imprinting the inflated bag by said marking device during the time interval that the space between adjacent moving products is adjoining the marking device.

3. The method of claim 2 including the additional steps of returning the inflated flexible bag to its non-laterally shifted position, out of contact with said marking device; filling the product into the inflated bag and moving the bagged product past the marking device.

4. In a product packaging machine, the combination of a continuous product flow bagging apparatus having an imprint station, and a means for imprinting inflated flexible product bags prior to a bag filling operation, and means to inflate a product bag positioned adjacent the imprint station to elevate an upper imprint surface of the bag into proximity of a marking device carried by said imprinting means at the imprint station, and means to fixedly retain an open end portion of said bag in a product filling position, said imprint station being laterally disposed relative to a product flow through the bagging apparatus in order to provide unobstructed product movement past the imprinting station, and means to laterally shift a portion of the inflated flexible bag remote from the open end portion, to urge the bag's imprint surface against the marking device to accommodate imprinting the bag's imprint surface by the imprinting means.

5. The product packaging machine of claim 4, wherein the means to laterally shift the bag's imprint surface against the marking device comprises a pressure means directed against a sidewall of the inflated bag.

6. The product packaging machine of claim 5, wherein the pressure means comprises a fluid cylinder having an extensible pusher member arranged to abut the bag sidewall to shift a closed end portion of the inflated bag, with the imprint surface thereon, laterally into the imprint station.

7. The product packaging machine of claim 6, wherein the pusher member is provided with a soft yieldable abutting surface.

8. The product packaging machine of claim 5, wherein the pressure means comprises an air jet means arranged to shift a closed end portion of the inflated bag, having the imprint surface thereon, laterally into the imprint station.

9. The product packaging machine of claim 8, wherein the air jet means includes a small orifice nozzle arranged to direct a jet of air against a spot area of the bag sidewall.

10. The product packaging machine of claim 8, wherein the air jet means includes a plurality of vertically disposed nozzles arranged to direct jets of air against a plurality of spot areas extending vertically along the bag sidewall.

11. The product packaging machine of claim 8, wherein the air jet means includes a vertically elongated nozzle arranged to direct a vertically elongated jet of air against substantially the full height sidewall.

12. In a product packaging machine comprising a product filling means arranged to continuously convey packageable products along a conveying surface from a product receiving station to a product discharge station in a spaced and generally aligned orientation and having a bag inflating station intermediate the receiving and discharge stations; an inflation means arranged to inflate a top bag of a stack of deflated, flattened flexible product bags positioned at the inflating station; means to fixedly retain an open end portion of said bag whereby the inflated bag will intercept a product moving along the conveying surface and will be carried along with the product to the discharge station, wherein the improvement provides:

An imprinting station adjacent the inflating station, having an imprinting means with a marking device thereon positioned laterally offset of the conveying surface to allow unobstructed product flow past the imprinting station;

means to laterally shift a portion of the inflated bag, remote from said open end portion, and having an imprint surface thereon, against the marking device prior to filling the bag with a product;

an anvil means carried by said imprinting means;

means for moving said anvil toward said marking device to collapse a portion of the inflated bag to press the imprint surface against the marking device and for withdrawing the anvil from the marking device;

said inflation means returning the portion of the bag to its non-laterally shifted position, out of contact with the marking device; and a timing means arranged to sequentially control; inflation of the top bag to lift the imprint surface into proximity of the marking device, lateral shifting of the imprint surface against the marking device, activating the means for moving the anvil toward said marking device, and for withdrawing the anvil, all in timed relationship with the conveying movements of the spaced products along the conveying surface whereby the product flow is unimpeded.

13. A method of imprinting product bags which comprises the steps of providing a linear flow of spaced apart product, positioning a stack of flexible bags having an open end and an opposed closed end with intermediate substantially continuous side walls in the path of product flow, maintaining said stack of bags in said path with the open ends of said bags directed to receive product moving in the path of product flow, inflating said bags one at a time from the top of said stack by an air jet directed at a forward open end of said stack, laterally shifting a portion of each of said inflated bags sideways of the path of product flow, collapsing a shifted portion of said inflated bag by entrapment between a relatively moving anvil member and a printing head member, imprinting indicia on a portion of said collapsed portion by said printing head member, releasing said collapsed portion from between said anvil member and said printing head member, substantially returning said shifted portion to said path, all while maintaining said inflation of said bag by said air jet, and thereafter filling said bag with product moving in said path.

14. The method of imprinting inflatable single open end flexible product bags which comprises the steps of positioning a stack of deflated open end product bags in a position to be filled by product, directing an air jet towards the open end of a topmost bag of said stack, inflating the topmost bag by said air jet, maintaining said air jet, shifting a portion of said inflated topmost bag, remote from the open end, laterally into an imprint area between relatively moving anvil and marker head members, collapsing a portion of said shifted portion of said inflated bag between said anvil and marker head and marking a portion of said collapsed portion by said marking head, releasing said collapsed portion from between said anvil and said marking head, returning the portion of the flexible bag to the non-laterally shifted position, filling said marked topmost bag with product and withdrawing said product filled marked bag from the topmost position of said stack, and repeating the sequence of inflating, shifting, collapsing, marking, releasing, filling, and withdrawing successively with each underlying bag of the stack.

* * * * *